US006983633B2

(12) United States Patent
Holmgren et al.

(10) Patent No.: US 6,983,633 B2
(45) Date of Patent: Jan. 10, 2006

(54) APPARATUS FOR ROLL HEMMING WITH ZERO ANGLE DEFLECTION

(75) Inventors: Mats Holmgren, Ryd (SE); Magnus Mattsson, Asarum (SE); Mikael Stigsson, Svängsta (SE)

(73) Assignee: Ford Global Technologies, LLC, Dearborn, MI (US)

( * ) Notice: Subject to any disclaimer, the term of this patent is extended or adjusted under 35 U.S.C. 154(b) by 244 days.

(21) Appl. No.: 10/605,770

(22) Filed: Oct. 24, 2003

(65) Prior Publication Data

US 2005/0086989 A1 Apr. 28, 2005

(51) Int. Cl.
*B21D 39/02* (2006.01)

(52) U.S. Cl. ..... 72/220; 29/243.58

(58) Field of Classification Search ..... 72/220, 72/214, 245, 210; 29/243.58, 243.57
See application file for complete search history.

(56) References Cited

U.S. PATENT DOCUMENTS 4,395,894 A 8/1983 McCorvey
4,726,107 A 2/1988 Knudson
5,038,597 A * 8/1991 Dorsett ..... 72/450
5,050,422 A 9/1991 Dorsett
5,083,355 A 1/1992 Dacey, Jr.
5,228,190 A * 7/1993 Sawa ..... 29/715
5,272,903 A 12/1993 Evans
5,357,665 A 10/1994 Fukui et al.
6,161,410 A 12/2000 Shook et al.
6,314,783 B1 11/2001 Patrick
6,418,771 B1 7/2002 Raffin et al.
6,467,324 B2 10/2002 Patrick
6,477,880 B1 11/2002 Zimmer

FOREIGN PATENT DOCUMENTS

JP 2000246351 A * 9/2000

* cited by examiner

*Primary Examiner*—Derris H. Banks
*Assistant Examiner*—Debra M Wolfe
(74) *Attorney, Agent, or Firm*—Brooks Kushman P.C.; Fredrick Owens

(57) ABSTRACT

A hemming tool providing a plurality of rollers for forming a hem flange. The rollers are disposed on an end effector that includes a pair of links that connect a tool support to a stationary bracket. The tool support and stationary bracket are shiftably mounted relative to each other in the manner of a four-bar link and shift relative to each other against the force of a force transducer or spring that moderates the force applied by the hemming tool to a workpiece by the selected roller.

12 Claims, 5 Drawing Sheets

APPARATUS FOR ROLL HEMMING WITH ZERO ANGLE DEFLECTION

BACKGROUND OF INVENTION

1. Field of the Invention

The present invention relates to a robot manipulated roll hem forming apparatus.

2. Background Art

Roll hem forming is a production process that is used to join a sheet metal outer panel to an inner panel by forming a hem flange. The hem flange is formed by bending a peripheral flange of an outer panel from a generally perpendicular orientation to a reversely turned orientation over an outwardly extending flange of an inner, reinforcement panel. A robot may be used to manipulate an end effector tool having a roller that is rolled against the peripheral flange of the outer panel to cause it to overlie the outwardly extending flange of the inner panel. In a robotic hemming system, the robot manipulates the roller about the edges to be hemmed.

Hard robot systems use precise position control of the location of the roller to press the outer panel peripheral flange against an anvil or solid supporting surface. A principal problem associated with hard robot systems is that they require precise position programming and lack flexibility. The end effector roller must be exactly located within about 0.1 mm or panel quality problems may be encountered due to application of excessive or inadequate force to the hem flange. The range of force applied to properly form an aluminum hem is between 150 and 350 psi. Other materials such as steel or specialized alloys would have different ranges of acceptable force application. A hem may be inadequately formed if insufficient force is applied resulting in a partially formed hem and potential for movement of the inner flange. If excessive force is applied to the hem, the peripheral flange of the outer panel may split or otherwise be distorted. Robots that are capable of meeting these exacting requirements are more expensive than standard robots.

Force control robot systems have been proposed in which a force transducer, or spring element, is incorporated into the end effector to address problems associated with hard robotic hemming systems. The force transducer moderates the force applied by the robot arm to the hem by the roller. Force control systems allow for limited misalignment of the hemming roller relative to the anvil. Examples of force transducers used in force control systems include mechanical springs, hydraulic dampers and air springs. A disadvantage associated with conventional force control systems is that the roller must generally be in line with the force transducer and robot arm or an angular deflection error will arise.

One example of a force control system is disclosed in U.S. Pat. No. 5,228,190 in which a slide block is incorporated in the end effector to connect the roller to a mechanical spring biasing member. Another example of a force control system is disclosed in U.S. Pat. No. 5,038,597 that discloses an end effector incorporating a parallelogram linkage that engages a resilient biasing element to bias the roller to a starting position. A hydraulic cylinder is provided to extend and retract the roller relative to the workpiece. With either of these prior art systems, only a single roller is provided even though in many hemming operations long straight hems are performed more quickly by a large diameter roller. Tight radius hems and hems in confined locations are preferably formed by means of smaller diameter rollers. It is necessary to change out the end effector to provide large and small rollers to hem panels requiring large and small rollers in such prior art force controlled robotic hemming systems. Changing out an end effector is time consuming and increases the cycle time of the hemming operation.

Another disadvantage of conventional systems is that the robot must extensively articulate the end effector to position the roller relative to the anvil surface and flanges to be hemmed. This problem is associated with both hard robotic hemming systems and force controlled hemming systems. Generally, a single roller must be moved by the robot to different angular orientations for a pre-hemming step and a final hemming step. In the pre-hemming step, the peripheral flange of the outer panel is formed to an acute angle of about 45° or may be formed in a two-step process to acute angles of 30° and then 60° to reduce forming stresses applied to the hem. Moving the roller to different angular orientations generally requires complex manipulations of the robot arm that increase cycle time.

There is a need for an improved hem roller end effector that includes a force transducer and a plurality of different rollers to provide an appropriately sized roller for different hem areas and that also may provide rollers oriented at different angular orientations relative to the end of the robot arm. The above problems and needs are addressed by Applicants' invention as summarized below.

SUMMARY OF INVENTION

According to one aspect of the present invention a robot manipulated hem forming roller tool for a robot having an arm with a receptacle for an end effector on one end. The end effector is adapted to be received in the receptacle on the end of the robot arm. A linkage is provided that comprises a bracket extending from the end effector, a tool support member, and two links that connect the bracket and the tool support member together in the manner of a four bar link. A pre-hem roller is disposed on the tool support member at a first angular orientation relative to the tool support member. A final hemming roller is disposed on the arm at a second angular orientation relative to the tool support member that is different than the angular orientation of the pre-hem roller. A force transducer operatively engages the tool support member to limit force supplied by the robot arm to the rollers through the tool support member.

According to another aspect of the invention, a roll form hem tool is provided with a linkage comprising a bracket, a tool support arm having a back end and a distal end, and two links that connect the bracket and the back end of the tool support arm together in a four bar linkage. The tool support arm is moveable relative to the bracket and a force transducer engages the tool support arm and the bracket to limit force applied by the tool support arm. A first roller is disposed on the tool support arm at a first angular orientation relative to the tool support arm and a second roller is disposed on the tool support arm at a second angular orientation relative to the tool support arm that is different then the first angular orientation. Additional rollers can also be provided on the tool support arm.

According to other aspects of the invention the tool support member arm is supported by the linkage for limited movement and is biased by the force transducer into an extended position. Upon engagement by one of the rollers with a workpiece to form a hem on the workpiece, the force applied to the workpiece is limited by the force transducer. The linkage transfers a spring force from the force transducer in a linear direction to the rollers that engages a workpiece. The rollers are disposed generally in alignment with the end effector adaptor or force transducer so that the force is applied in a linear direction to a hem flange by the roller. Stated another way, the rollers are disposed so that the force applied to a workpiece is in a direction normal to an axis of rotation of one of the rollers wherein the force transducer is displaced in the same linear direction.

According to another aspect of the invention more than one final hemming roller and more than one pre-hem roller may be provided on the tool support member or arm. By providing additional rollers, the time required to manipulate the end effector with the robot arm may be reduced.

These and other aspects of the present invention are more fully described below with reference to the attached drawings.

DETAILED DESCRIPTION

Figure 1:
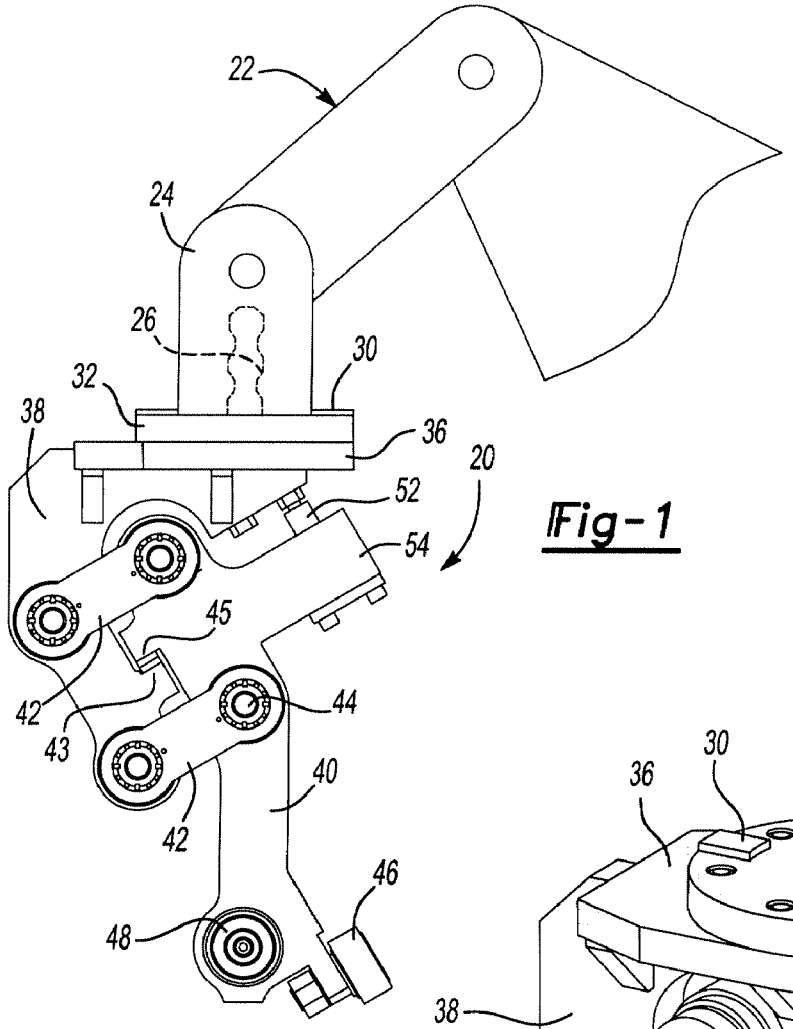
FIG. 1 is a side elevation view of a hemming tool end effector attached to a robot arm.
Figure 2:
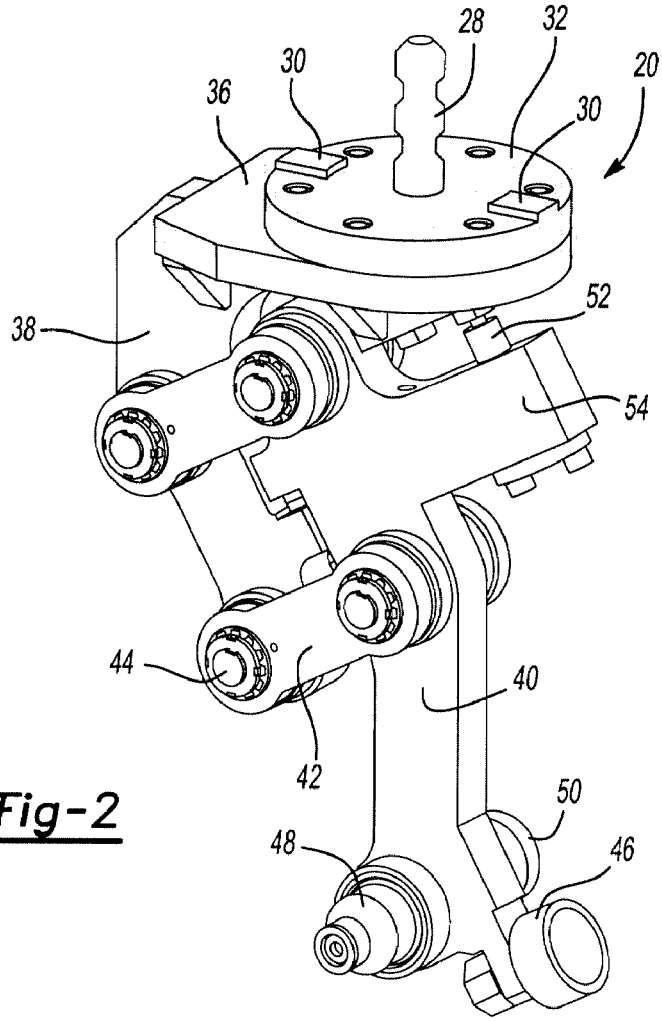
FIG. 2 is a perspective view of one embodiment of a hemming tool end effector.

Referring now to FIGS. 1 and 2, an end effector hemming tool 20 is shown connected to a robot arm 22. While the invention is illustrated in FIG. 1 secured to a robot arm 22, other apparatus for manipulating a roll hemming tool could be used in accordance with the present invention. The robot arm 22 has an adapter 24 including a receptacle 26 for receiving a ribbed shaft 28 of the hemming tool 20. Radial alignment guides 30 are provided on a circular plate 32 of the hemming tool 20. A tooling plate 36 is attached to the circular plate 32 and supports a stationary bracket 38. A tool support 40 is shiftably mounted relative to the stationary bracket 38 by means of a pair of links 42. The stationary bracket 38 comprises a bracket stop 43 formed by an inner surface located between the pair of links 42, which are connected by bearings 44. Similarly, a coupler stop 45 is formed in the surface of tool support 40 located between the bearings 44 and adjacent to the bracket stop 43. The links 42, tool support 40 and stationary bracket 38 in combination form a four-bar link that permits the tool support 40 to move in a generally linear direction relative to the bracket 38, as limited by stops 43,45. The bearings 44 also connect the links 42 to the tool support 40 and stationary bracket 38.

A distal roller 46 is provided on one end of the tool support 40. The distal roller 46 may be used to form a pre-hem or final hem as will be more fully described below. A first coaxial roller 48 and a second coaxial roller 50 are secured to the tool support 40 on a common axis. The first and second coaxial rollers 48 and 50 may have different diameters to perform different hem forming operations as will be more fully described below. A spring 52, or force transducer, is supported on an arm 54 of the tool support 40. The force transducer 52, or spring, may be a mechanical spring, air spring, hydraulic cylinder, or pneumatic cylinder. The force transducer 52 functions to bias the tool support 40 in one direction relative to the bracket 38. The tool support 40 is resiliently supported relative to the bracket 38 so that forces applied by one of the rollers is moderated or held within an acceptable range of pressure.

Figure 3:
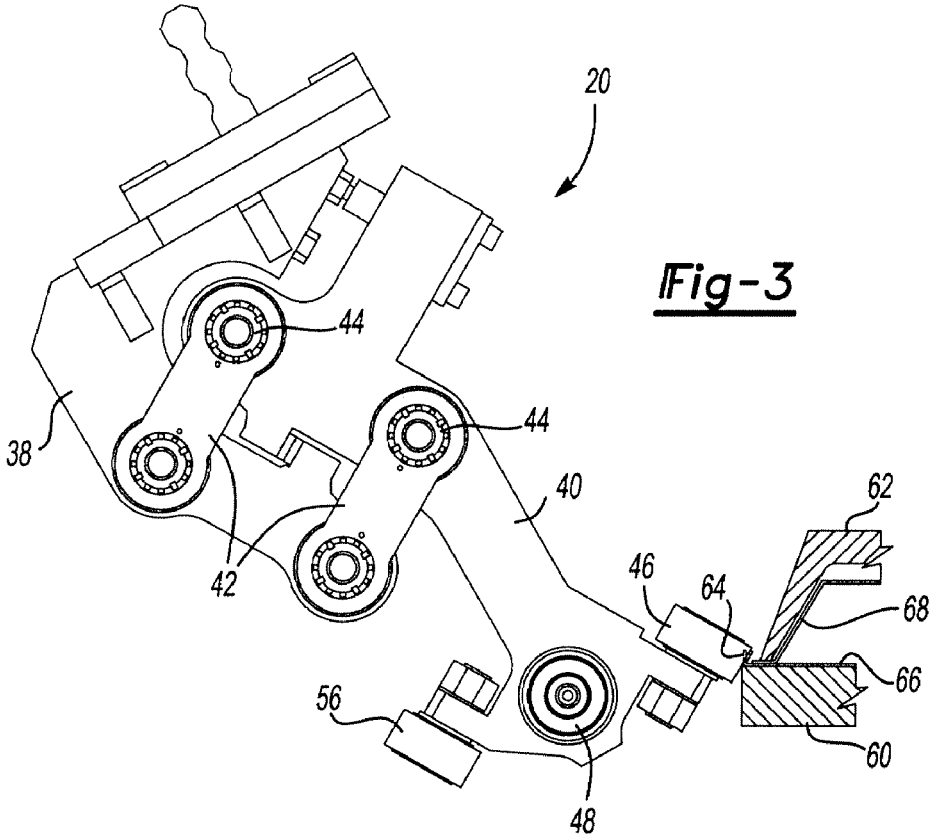
FIG. 3 is a side elevation view of an alternative embodiment of the hemming tool end effector.

Referring now to FIG. 3, an alternative embodiment of the hemming tool 20 is shown that includes an aft roller 56 that is oppositely oriented relative to the distal roller 46. The aft roller may be of the same diameter as the distal roller 46 or may be of a different diameter to provide flexibility in selecting a proper size roller for rolling either long flat sections with a larger diameter roller or rolling tighter curved or contoured sections with a smaller diameter roller. The aft roller 56 is secured to the tool support 40 that is supported on links 42 relative to the stationary bracket 38. Bearings 44 are used to connect the links 42 to the bracket 38 and tool support 40.

As shown in FIG. 3, the distal roller 46 is shown engaging a workpiece that is supported on an anvil support 60. The workpiece is held on the anvil support 60 by means of a work holding clamp 62. A hem flange 64 is shown as it is initially formed in a pre-hemming operation. The hem flange 64 is part of an outer panel 66 that is to be joined to an inner panel 68 by the hem flange 64.

Figure 4:
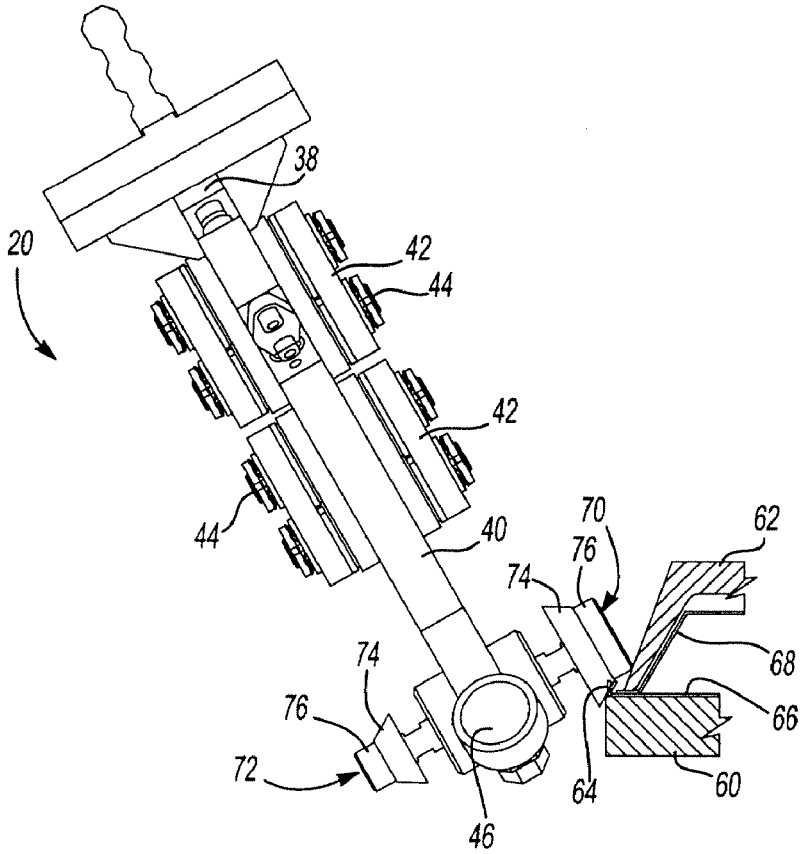
FIG. 4 is a front elevation view of a hemming tool end effector disposed at an angular orientation to pre-hem a hem flange.

Referring now to FIG. 4, the alternative embodiment of FIG. 3 is shown wherein a large radius combination roller 70 and a small radius combination roller 72 correspond to the first and second coaxial rollers 48 and 50, as shown in FIG. 2. The combination rollers 70, 72 each have a partially conical portion 74 and a cylindrical portion 76 that may be used to form the hem flange 64 to different angular orientations as appropriate to perform pre-hemming and final hemming passes on the hem flange 64 of the workpiece.

As shown in FIG. 4, the partial conical portion 74 of the large radius combination roller 70 is being used to form a 60° pre-hem pass on the hem flange 64.

Figure 5:
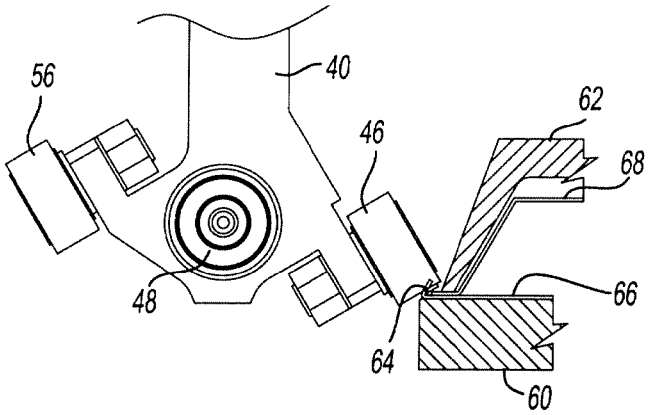
FIG. 5 is a fragmentary elevation view of a hemming tool forming a 45° pre-hem.

Referring now to FIG. 5, the distal roller 46 is shown engaging the hem flange 64 of the workpiece that is held in place on anvil 60 by work holding clamp 62. The distal roller 46 is a cylindrical roller that is supported on the tool support 40.

Figure 6:
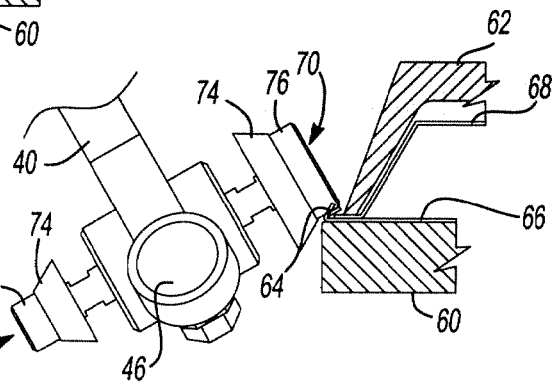
FIG. 6 is a fragmentary elevation view of a hemming tool forming a 45° pre-hem.

Referring to FIG. 6, the hemming tool 20 is shown with a large radius combination roller 70 engaging the hem flange 64 of the workpiece. This view should be compared to FIG. 4 wherein a first pre-hemming pass forms the hem flange 64 to approximately a 60° angle with the partially conical portion 74 of the combination roller 70. To then form a pre-hemming pass forming the hem flange to a 30° angle, the roller must only be indexed slightly by the robot arm so that the cylindrical portion 76 of the combination roller 70 may then be used to form the 30° pre-hemming pass. The large radius combination roller 70 is preferred for long straight hem flanges, while the tool could be reversed in orientation so that the small radius combination roller 72 engages the workpiece as would be preferred for forming a hem in contoured areas or areas where the hem must be formed around a curved portion or corner of the workpiece.

Figure 7:
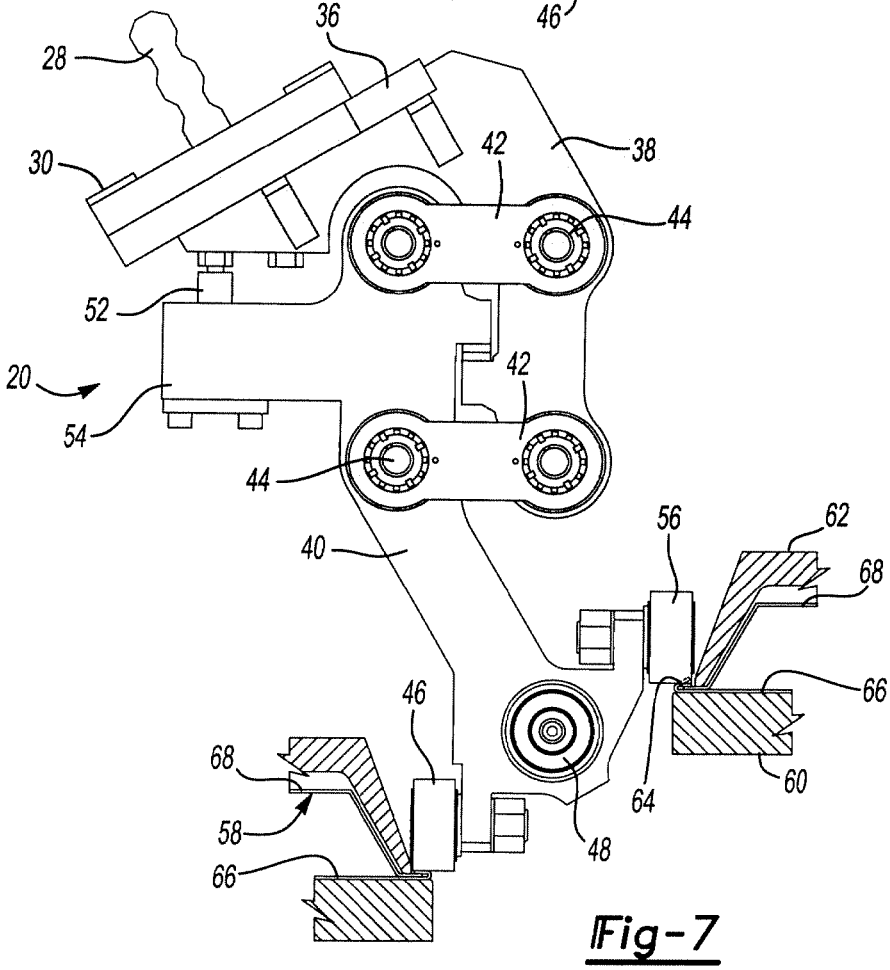
FIG. 7 is a elevation view of the alternative end effector shown in FIG. 3 being used to form a final hem flange.

Referring to FIG. 7, a hemming tool 20 is shown alternatively forming a hem with the distal roller 46 and the aft roller 56. The tool would be used to form a single hem with a single roller.

As shown in FIG. 7, the distal roller 46 is engaging the outer panel 66 on the left hand side of the view to perform a final hemming pass on the workpiece. FIG. 7 also shows the aft roller 56 on the right hand side performing a final hemming pass on the hem flange 64. As the tool support 40 engages either the workpiece on the right side with the aft roller 56, or the workpiece on the left side with the distal roller 46, the force applied by either roller is moderated by means of force transducer 52 that is mounted on the arm 54. The arm 54, as illustrated, is located between the two links 42 to assure that there is a zero angle deflection of forces transmitted by the robot arm to the rollers 46 or 56. This same zero angle deflection is achieved by the coaxial rollers 48, 50 (not shown) due to the arrangement of the two links 42 that support the tool support 40 relative to the bracket 38 for linear movement. The arm 54 moves in a linear direction relative to the bracket 38. In this way, forces applied by the rollers 46, 48, 50, 56 are moderated by the force transducer 52.

Figure 8:
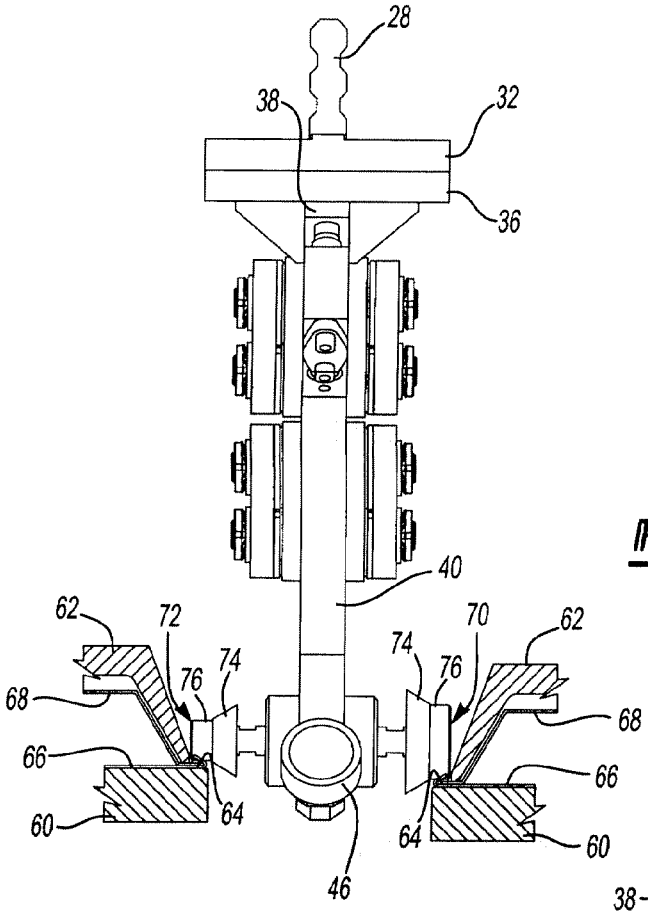
FIG. 8 is a front elevation view of a hemming tool end effector forming a final hem flange in an alternative approach.

Referring now to FIG. 8, the end effector 20 is shown with a large radius combination roller 70 and small radius combination roller 72 are provided on the tool support 40. As described above with regard to FIG. 7, the drawing illustrates two hems being alternatively formed. Only one roller would be engaged with the hem flange 64 at one time. The rollers 70 and 72 are selected and manipulated to provide an appropriate radius roller for different hemming applications.

Figure 9:
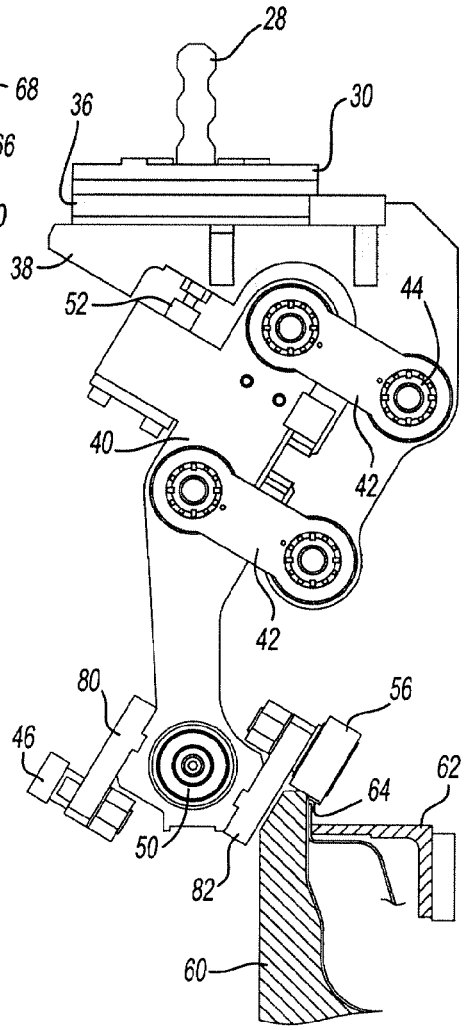
FIG. 9 is a side elevation view of another alternative embodiment of the hem tool end effector shown forming a 30° pre-hem on a workpiece.

Referring to FIG. 9, another alternative embodiment of the hemming tool 20 is shown that includes a first roller arm 80 that supports distal roller 46 and a second roller arm 82 that supports aft roller 56. The roller arms 80 and 82 may be provided to simplify servicing of the rollers and to provide additional flexibility in roller location. The tool support 40 is supported by means of the links 42 relative to the bracket 38, as previously described, and zero angle deflection is realized even though the aft roller 56 and distal roller 46 are supported on the roller arms 80 and 82.

In FIG. 9, roller 56 is shown forming a 60° pre-hem pass on hem flange 64. The workpiece is held by anvil support 60 and work holding clamp 62 in a vertical orientation.

Figure 10:
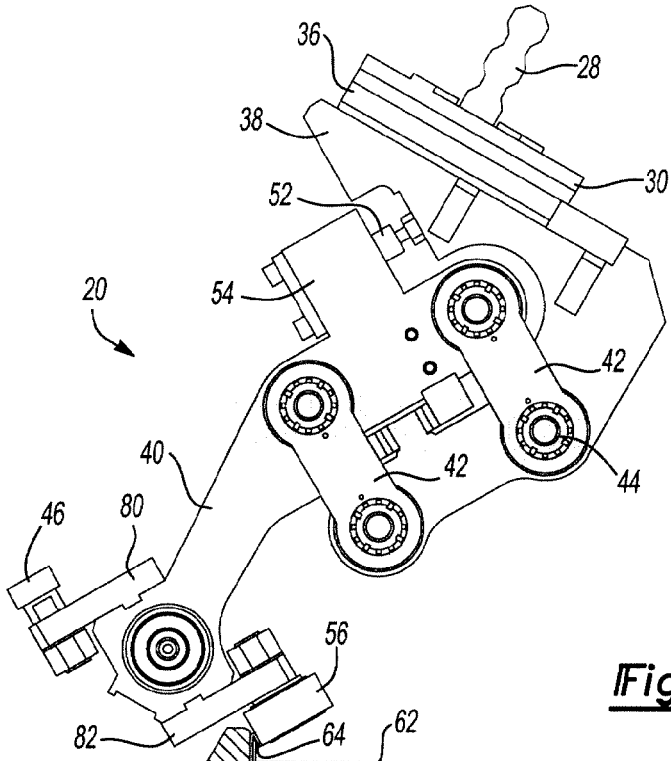
FIG. 10 is a side elevation view of another alternative embodiment of the hem tool end effector shown forming a 60° pre-hem on a workpiece.

Referring to FIG. 10, the tool 20 is shown at a different angular orientation relative to the workpiece and the anvil 60 to perform a 30° pre-hemming pass on the hem flange 64. The tool must only be moved 30° relative to the workpiece to change from a 60° pre-hem pass, as previously seen in FIG. 9, to a 30° pre-hem pass using the cylindrical roller 56.

Figure 11:
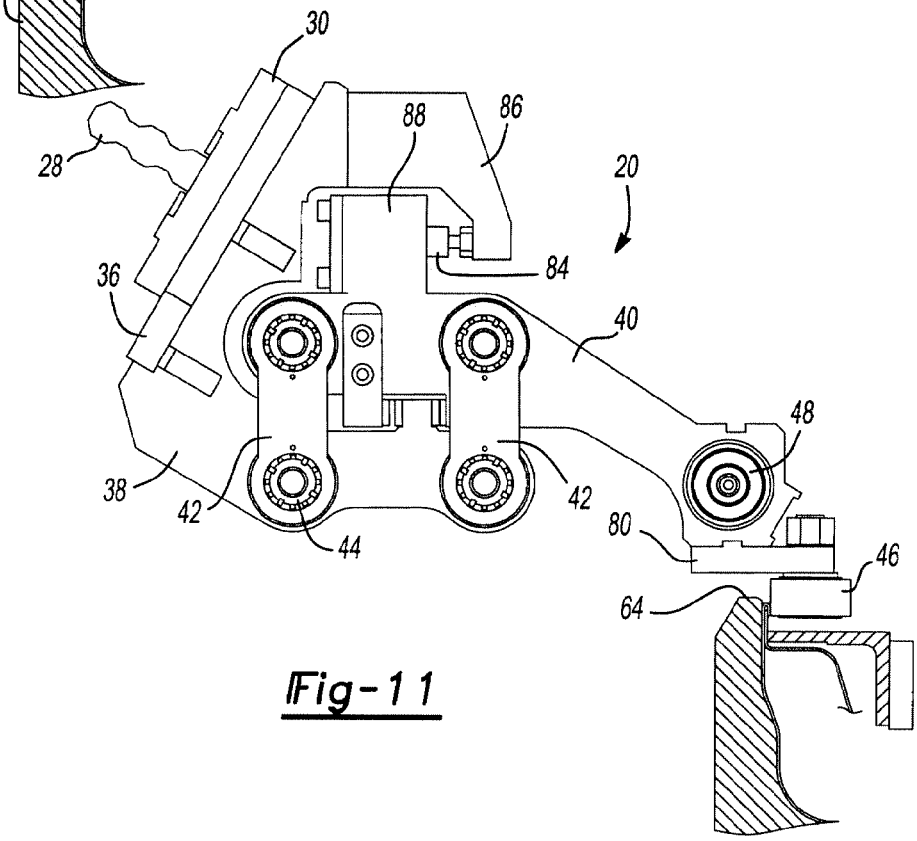
FIG. 11 is another alternative embodiment of a roll hem effector forming a final hem on a workpiece.

Referring to FIG. 11, an alternative embodiment of the hemming tool 20 is shown that applies a pulling force to the hem flange 64 with distal roller 46. A spring 84 exerts a biasing force against a reverse orientation extension 86 that is secured to the bracket 38. The spring 84 is mounted on arm 88 that extends from the tool support 40 between the links 42. The spring 84 biases the arm 88 away from the extension 86 so that when force is applied by the roller 46 to the hem flange 64 the force is moderated by the spring 84 that functions as a force transducer. The force transducer could alternatively be a mechanical spring, air spring, pneumatic cylinder or hydraulic cylinder.

While the best mode for carrying out the invention has been described in detail, those familiar with the art to which this invention relates will recognize various alternative designs and embodiments for practicing the invention as defined by the following claims.

What is claimed is:

1. A robot manipulated roll form hem tool, the robot having an arm with a receptacle on one end, the hem tool comprising:

an end effector adapter that is adapted to be received in the receptacle on the end of the robot arm;

a linkage comprising a bracket extending from the end effector, a tool support member, and two links that connect the bracket and the tool support member together as a four bar linkage;

a first roller disposed on the tool support member with an axis of rotation that is at a first angular orientation relative to the tool support member;

a second roller disposed on the tool support member with an axis of rotation at a second angular orientation relative to the tool support member that is different than the first angular orientation; and a force transducer operatively engaging the tool support member to limit force applied by the robot arm to the rollers through the tool support member.

2. The hem tool of claim 1 wherein the tool support member is supported by the linkage for limited movement relative to the end effector adapter and is biased by the force transducer into an extended position, wherein upon engagement by one of the rollers with a workpiece to form a hem on the workpiece the force applied to the workpiece is limited by the force transducer.

3. The hem tool of claim 1 wherein a third roller is provided on the tool support member with an axis of rotation that is at a third angular orientation that is different than the first and second angular orientations.

4. The hem tool of claim 1 wherein a fourth roller is provided on the tool support member with an axis of rotation that is at a fourth angular orientation that is different than the first, second, and third angular orientations relative to the tool support member.

5. The hem tool of claim 1 wherein one of the rollers applies a force to the force transducer that flexes in a linear direction as the roller engages a workpiece.

6. The hem tool of claim 1 wherein the rollers are disposed generally in alignment with the end effector adapter and the force transducer so that force is applied to a hem flange to be formed on a workpiece in a direction that is normal to the axis of rotation of the rollers.

7. A roll form hem tool, comprising:

a linkage comprising a bracket, a tool support arm having a back end and a distal end, two links that connect the bracket and the back end together as a four bar linkage with the tool support arm being moveable relative to the bracket, and a force transducer engaging the tool support arm and the bracket to limit force applied by the tool support arm;

a pre-hem roller disposed on the tool support arm at a first angular orientation relative to the tool support arm; and a final hem roller disposed on the tool support arm at a second angular orientation relative to the tool support arm that is different than the first angular orientation, wherein the tool may use the pre-hem roller to form a pre-hem bending operation and use the final hem roller to form a final hemming operation.

8. The hem tool of claim 7 wherein the tool support arm is supported by the linkage for limited movement relative to the bracket in a linear flexing action, wherein upon engagement by one of the rollers with a workpiece to form a hem on the workpiece the force applied to the workpiece is limited by the force transducer.

9. The hem tool of claim 7 wherein a second final hemming roller is provided on the tool support arm.

10. The hem tool of claim 7 wherein a second pre-hem roller is provided on the tool support arm at a different angular orientation relative to the tool support arm than the first angular orientation.

11. The hem tool of claim 7 wherein the linkage transfers a spring force from the force transducer in a linear direction to one of the rollers as the roller engages a workpiece.

12. The hem tool of claim 7 wherein the pre-hem roller and the final hemming roller are disposed generally in alignment with the force transducer so that a force applied to a workpiece by either the pre-hem roller or the final hemming roller in a direction normal to an axis of rotation of one of the rollers is transferred in a linear direction to the force transducer.

* * * * *